US007203456B1

(12) United States Patent
Beard et al.

(10) Patent No.: US 7,203,456 B1
(45) Date of Patent: Apr. 10, 2007

(54) METHOD AND APPARATUS FOR TIME AND SPACE DOMAIN SHIFTING OF BROADCAST SIGNALS

(75) Inventors: Paul Beard, Milpitas, CA (US); Enrique Alfaro, Palo Alto, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 498 days.

(21) Appl. No.: 09/791,029

(22) Filed: Feb. 20, 2001

Related U.S. Application Data

(60) Provisional application No. 60/184,849, filed on Feb. 25, 2000.

(51) Int. Cl.
*H04H 1/00* (2006.01)

(52) U.S. Cl. ..... 455/3.01; 455/421; 455/456.2

(58) Field of Classification Search ..... 455/404.2, 455/414.1, 414.3, 414.4, 414.2–4, 421, 432.1, 455/432.2, 454, 456.1, 456.2, 456.5, 517, 455/435.1, 445, 12.1, 412.1, 440, 3.02, 3.03, 455/431.1, 432.3, 18, 20, 21, 550.1, 74, 41.2, 455/427, 3.01, 422.1; 709/218, 231; 725/14, 725/142, 92, 115; 370/487, 389
See application file for complete search history.

(56) References Cited

U.S. PATENT DOCUMENTS 6,151,636 A * 11/2000 Schuster et al. ..... 709/247
6,198,927 B1 * 3/2001 Wright et al. ..... 455/435.1
6,347,216 B1 * 2/2002 Marko et al. ..... 455/12.1
6,377,573 B1 * 4/2002 Shaffer et al. ..... 455/553.1
6,411,992 B1 * 6/2002 Srinivasan et al. ..... 709/218
6,477,579 B1 * 11/2002 Kunkel et al. ..... 709/229
6,532,593 B1 * 3/2003 Moroney ..... 725/142
6,553,535 B1 * 4/2003 Asada et al. ..... 714/777
6,598,228 B2 * 7/2003 Hejna, Jr. ..... 725/91
6,614,470 B1 * 9/2003 Manowitz et al. ..... 348/211.2
6,658,663 B1 * 12/2003 Bruynsteen ..... 725/134

(Continued)

*Primary Examiner*—Edward F. Urban
*Assistant Examiner*—John J. Lee
(74) *Attorney, Agent, or Firm*—Marger Johnson & McCollom P.C.

(57) ABSTRACT

A method and apparatus for time and space domain shifting of broadcast signals is disclosed. A broadcast station in a first geographic location transmits in a first time frame a broadcast signal to a local receiver also located in the first geographic location. The local receiver encodes the broadcast signal into an encoded signal capable of being transmitted via a world wide network, and then transmits the encoded signal via the world wide network. The transmitted encoded signal is received by a media player located within a second geographic location outside the first geographic location and coupled to the world wide network, and the encoded signal is decoded by the media player such that information contained within the signal is capable of being reproduced. The information may be reproduced by the media player as the signal is received via the world wide network, or the reproduction of the information may be delayed to a predetermined time such that the time frame of the broadcast signal may be shifted from the first time frame to a second time frame. It is emphasized that this abstract is provided to comply with the rules requiring an abstract that will allow a searcher or other researcher to quickly ascertain the subject matter of the technical disclosure. It is submitted with the understanding that it will not be used to interpret or limit the scope or meaning of the claims.

20 Claims, 4 Drawing Sheets

U.S. PATENT DOCUMENTS 6,717,590 B1 * 4/2004 Sullivan ..... 345/716
6,728,776 B1 * 4/2004 Colbath ..... 709/231
2001/0029186 A1 * 10/2001 Canyon et al. ..... 455/462
2002/0046084 A1 * 4/2002 Steele et al. ..... 705/14
2002/0053078 A1 * 5/2002 Holtz et al. ..... 725/14

* cited by examiner

METHOD AND APPARATUS FOR TIME AND SPACE DOMAIN SHIFTING OF BROADCAST SIGNALS

CROSS REFERENCE TO RELATED APPLICATION

The present application claims priority to U.S. Provisional Application Ser. No. 60/184,849 filed Feb. 25, 2000. Said U.S. Provisional Application 60/184,849 is hereby incorporated by reference.

BACKGROUND

Broadcasts such as from local broadcast stations tend to generate a popular following among listeners or viewers who are in the geographic location of the broadcast station and who are capable of receiving the signal from the broadcast station. However, listeners and viewers may move away from the geographic location yet still desire to listen to the broadcasts. Since local broadcasts only cover a limited broadcast area limited by the transmission power of the broadcast station and by governmental regulations, a typical radio or television receiver is incapable of receiving the broadcast from the broadcast station when the radio or television receiver is outside the geographic location of the broadcast station. For example, a listener or viewer from England cannot receive the broadcast signal from the British Broadcasting Corporation (BBC) with his or her radio or television receiver in California. Thus, such a displaced British citizen would have to forgo listening to or viewing his favorite BBC programs when he or she is in California. Thus, it would be highly desirable to provide a method and apparatus that would allow such a person displaced from the geographic region to receive broadcast signals from a broadcast station even though the person may be located outside of the geographic location of the broadcast station. Furthermore, since a person displaced away from a geographic location may be located several time zones away from the time zone of the broadcast station, the time of the broadcast in the time zone of the displaced person may be inconvenient for listening or viewing the broadcast. For example, a 9 p.m. broadcast of a BBC program in England may be 1 p.m. in the time zone of the displaced person. The displaced person may not be able to listen to or view the broadcast at that time, and would prefer to watch the program at 9 p.m. in the time zone of the displaced person. Thus, it would be further highly desirable to provide a method and apparatus for delaying the listening or viewing of the geographically shifted broadcast such that the broadcast signal could be shifted in both the time domain and the space domain.

BRIEF DESCRIPTION OF THE DRAWINGS

The numerous advantages of the present invention may be better understood by those skilled in the art by reference to the accompanying figures in which.

DETAILED DESCRIPTION

Figure 1:
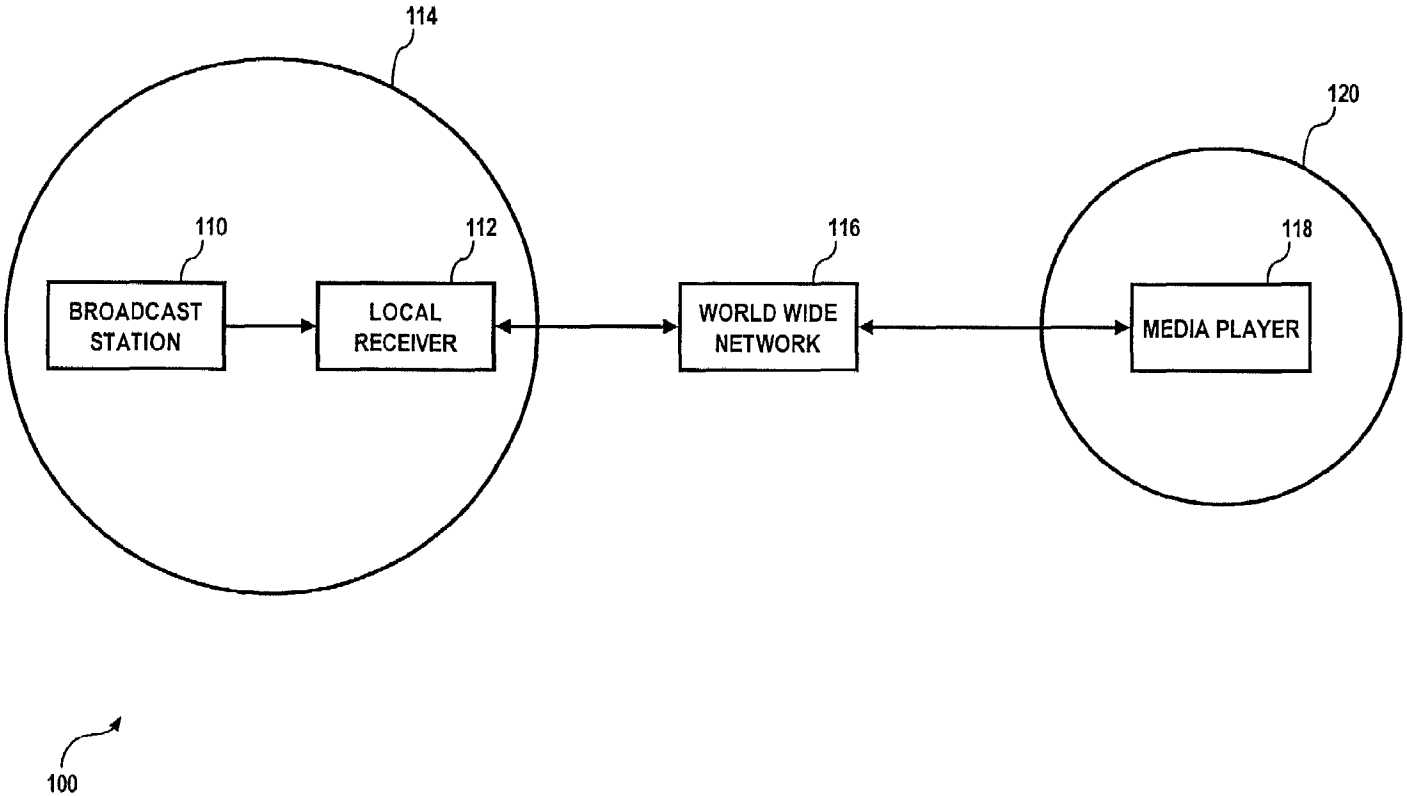
FIG. 1 is a block diagram of a system for time and space domain shifting of broadcast signals in accordance with the present invention.

Reference will now be made in detail to the presently preferred embodiment of the invention, an example of which is illustrated in the accompanying drawings. It should be noted that like reference numerals refer to like items throughout the drawing figures.

Referring now to FIG. 1, a block diagram of a system for time and space domain shifting of broadcast signals in accordance with the present invention will be discussed. In system 100, a broadcast station 110 broadcasts a signal to a local receiver 112 in a first geographic location 114. The signal broadcast by broadcast station contains information capable of being reproduced by an appropriate receiving device such as local receiver 112. For example, broadcast station 112 may broadcast a radio or a television signal to local receiver which may be a radio or television receiver, respectively. Typically, broadcast station 112 broadcasts a broadcast signal in a predefined geographic location 114 wherein the area included within geographic region in which an appropriate receiver is capable of receiving and demodulating the signal is determined by the transmission power of broadcast station 112 or governmental agencies (e.g., the Federal Communications Commission (FCC), etc.). In operation of system 100, local receiver 112 receives a signal broadcast by broadcast station 110 and encodes the signal into an encoded signal capable of being transmitted via a world wide network 116. World wide network 116 may be, for example, the Internet. In such an embodiment, local receiver 112 converts the broadcast signal from the broadcast format (e.g., frequency modulation (FM), amplitude modulation (AM), etc.) into an Internet format (e.g., point-to-point protocol (PPP), file transfer protocol (FTP), etc.). The broadcast signal is then capable of being transmitted via world wide network 116 to a media player 118 that is located outside of geographic location 114 in a second geographic location 120. For example, geographic location 114 may be New York, N.Y. and geographic location 120 may be Sunnyvale, Calif. Thus, media player 118 is capable of receiving a broadcast signal from broadcast station 110 even though media player 118 is located outside of geographic location 114, even distantly so, by receiving the signal from local receiver 112 via world wide network 116. When media player 118 receives the encoded broadcast signal via world wide network 116, media player decodes the encoded broadcast signal such that the information contained in the signal is capable of being reproduced by media player 118. Thus, the signal broadcast by broadcast station is thereby capable of being shifted in the space domain from a first position in space, e.g., geographic location 114, to a second position in space, e.g., geographic location 120. Furthermore, although media player 118 is capable of reproducing the information contained in the signal as it is received via world wide network 116 and decoded, media player 118 is also capable of storing the signal received via world wide network for retrieval and playback at a later time as desired by a user. The signal may be stored in an analog format, for example, on a magnetic tape of a videocassette recorder (VCR) coupled to media player 118, or in a digital format such as on a hard disk drive of media player 118. Thus, the signal broadcast by broadcast station 110 is thereby capable of being shifted in the time domain from a first time frame, e.g., the time frame of the broadcast from broadcast station 110, to a second time frame, e.g., the time frame of reproduction by media player 118.

Figure 2:
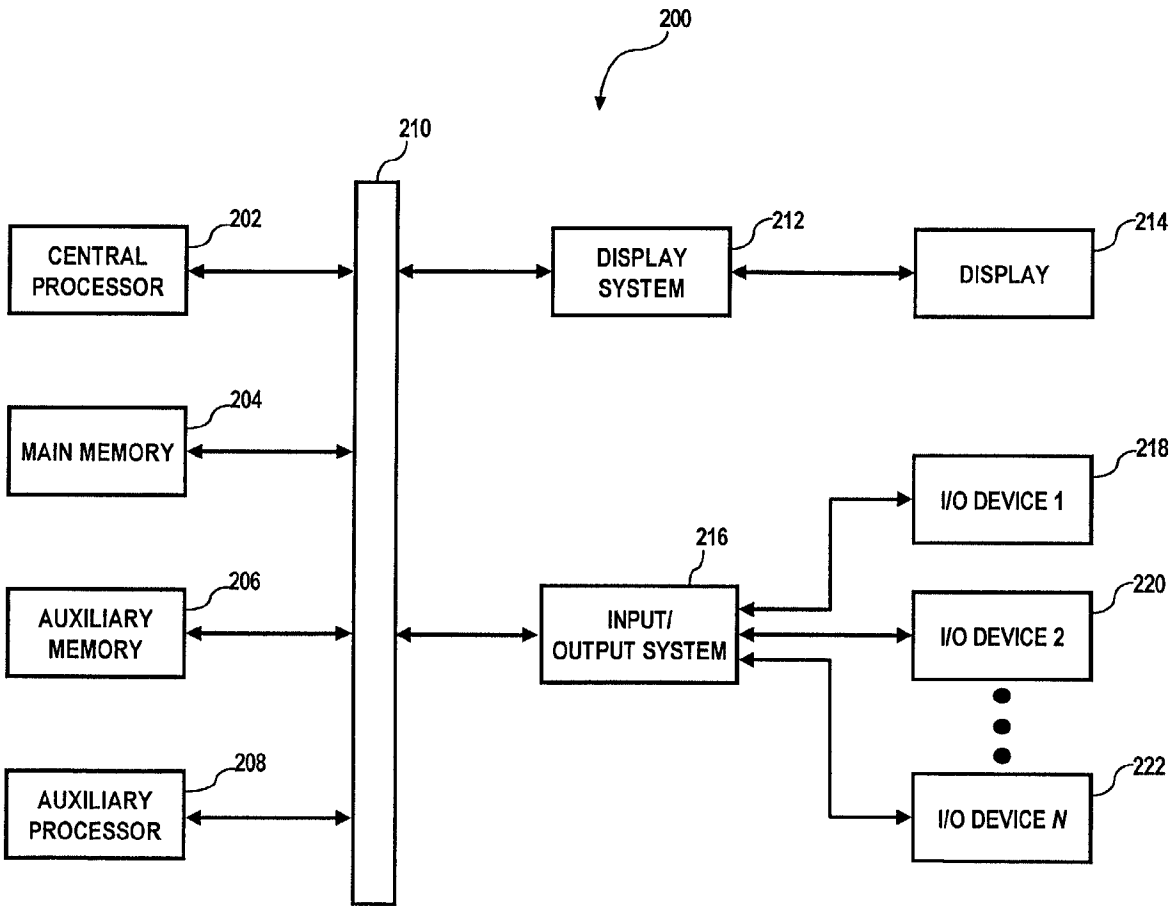
FIG. 2 is a block diagram of a computer system operable to embody the present invention.

Referring now to FIG. 2, a hardware system in accordance with the present invention is shown. The hardware system shown in FIG. 2 is generally representative of the hardware architecture of a computer system embodiment of the present invention. Computer system 200 may be configured to implement system 100 of FIG. 1, for example, by executing program 112 and program 120. A central processor 202 controls the computer system 200. Central processor 202 includes a central processing unit such as a microprocessor or microcontroller for executing programs, performing data manipulations and controlling the tasks of computer system 200. Communication with central processor 202 is implemented through a system bus 210 for transferring information among the components of computer system 200. Bus 210 may include a data channel for facilitating information transfer between storage and other peripheral components of computer system 200. Bus 210 further provides the set of signals required for communication with central processor 202 including a data bus, address bus, and control bus. Bus 210 may comprise any state of the art bus architecture according to promulgated standards, for example industry standard architecture (ISA), extended industry standard architecture (EISA), Micro Channel Architecture (MCA), peripheral component interconnect (PCI) local bus, standards promulgated by the Institute of Electrical and Electronics Engineers (IEEE) including IEEE 488 general-purpose interface bus (GPIB), IEEE 696/S-100, and so on. Furthermore, bus 210 may be compliant with any promulgated industry standard. For example, bus 210 may be designed in compliance with any of the following bus architectures: Industry Standard Architecture (ISA), Extended Industry Standard Architecture (EISA), Micro Channel Architecture, Peripheral Component Interconnect (PCI), Universal Serial Bus (USB), Access.bus, IEEE P1394, Apple Desktop Bus (ADB), Concentration Highway Interface (CHI), Fire Wire, Geo Port, or Small Computer Systems Interface (SCSI), for example.

Other components of computer system 200 include main memory 204, auxiliary memory 206, and an auxiliary processor 208 as required. Main memory 204 provides storage of instructions and data for programs executing on central processor 202. Main memory 204 is typically semiconductor based memory such as dynamic random access memory (DRAM) and or static random access memory (SRAM). Auxiliary memory 206 provides storage of instructions and data that are loaded into the main memory 204 before execution. Auxiliary memory 206 may include semiconductor based memory such as read-only memory (ROM), programmable read-only memory (PROM) erasable programmable read-only memory (EPROM), electrically erasable read-only memory (EEPROM), or flash memory (block oriented memory similar to EEPROM). Auxiliary memory 206 may also include a variety of non-semiconductor based memories, including but not limited to magnetic tape, drum, floppy disk, hard disk, optical, laser disk, compact disc read-only memory (CD-ROM), digital versatile disk read-only memory (DVD-ROM), digital versatile disk random-access memory (DVD-RAM), etc. Other varieties of memory devices are contemplated as well. Computer system 200 may optionally include an auxiliary processor 208 which may be a digital signal processor (a special-purpose microprocessor having an architecture suitable for fast execution of signal processing algorithms), a back-end processor (a slave processor subordinate to the main processing system), an additional microprocessor or controller for dual or multiple processor systems, or a coprocessor.

Computer system 200 further includes a display system 212 for connecting to a display device 214, and an input/output (I/O) system 216 for connecting to one or more I/O devices 218, 220, up to N number of I/O devices 222. Display system 212 may comprise a video display adapter having all of the components for driving the display device, including video random access memory (VRAM), buffer, and graphics engine as desired. Display device 214 may comprise a cathode ray-tube (CRT) type display such as a monitor or television, or may comprise alternative type of display technologies such as a liquid-crystal display (LCD), a light-emitting diode (LED) display, or a gas or plasma display. Input/output system 216 may comprise one or more controllers or adapters for providing interface functions between one or more of I/O devices 218–222. For example, input/output system 216 may comprise a serial port, parallel port, infrared port, network adapter, printer adapter, radio-frequency (RF) communications adapter, universal asynchronous receiver-transmitter (UART) port, etc., for interfacing between corresponding I/O devices such as a mouse, joystick, trackball, track pad, track stick, infrared transducers, printer, modem, RF modem, bar code reader, charge-coupled device (CCD) reader, scanner, compact disc (CD), compact disc read-only memory (CD-ROM), digital versatile disc (DVD), video capture device, touch screen, stylus, electro-acoustic transducer, microphone, speaker, etc. Input/output system 216 and I/O devices 218–222 may provide or receive analog or digital signals for communication between computer system 200 of the present invention and external devices, networks, or information sources. Input/output system 216 and I/O devices 218–222 preferably implement industry promulgated architecture standards, including Recommended Standard 232 (RS-232) promulgated by the Electrical Industries Association, Infrared Data Association (IrDA) standards, Ethernet IEEE 802 standards (e.g., IEEE 802.3 for broadband and baseband networks, IEEE 802.3z for Gigabit Ethernet, IEEE 802.4 for token passing bus networks, IEEE 802.5 for token ring networks, IEEE 802.6 for metropolitan area networks, 802.11 for wireless networks, and so on), Fibre Channel, digital subscriber line (DSL), asymmetric digital subscriber line (ASDL), frame relay, asynchronous transfer mode (ATM), integrated digital services network (ISDN), personal communications services (PCS), transmission control protocol/Internet protocol (TCP/IP), serial line Internet protocol/point to point protocol (SLIP/PPP), and so on. It should be appreciated that modification or reconfiguration of computer system 200 of FIG. 2 by one having ordinary skill in the art would not depart from the scope or the spirit of the present invention.

Figure 3:
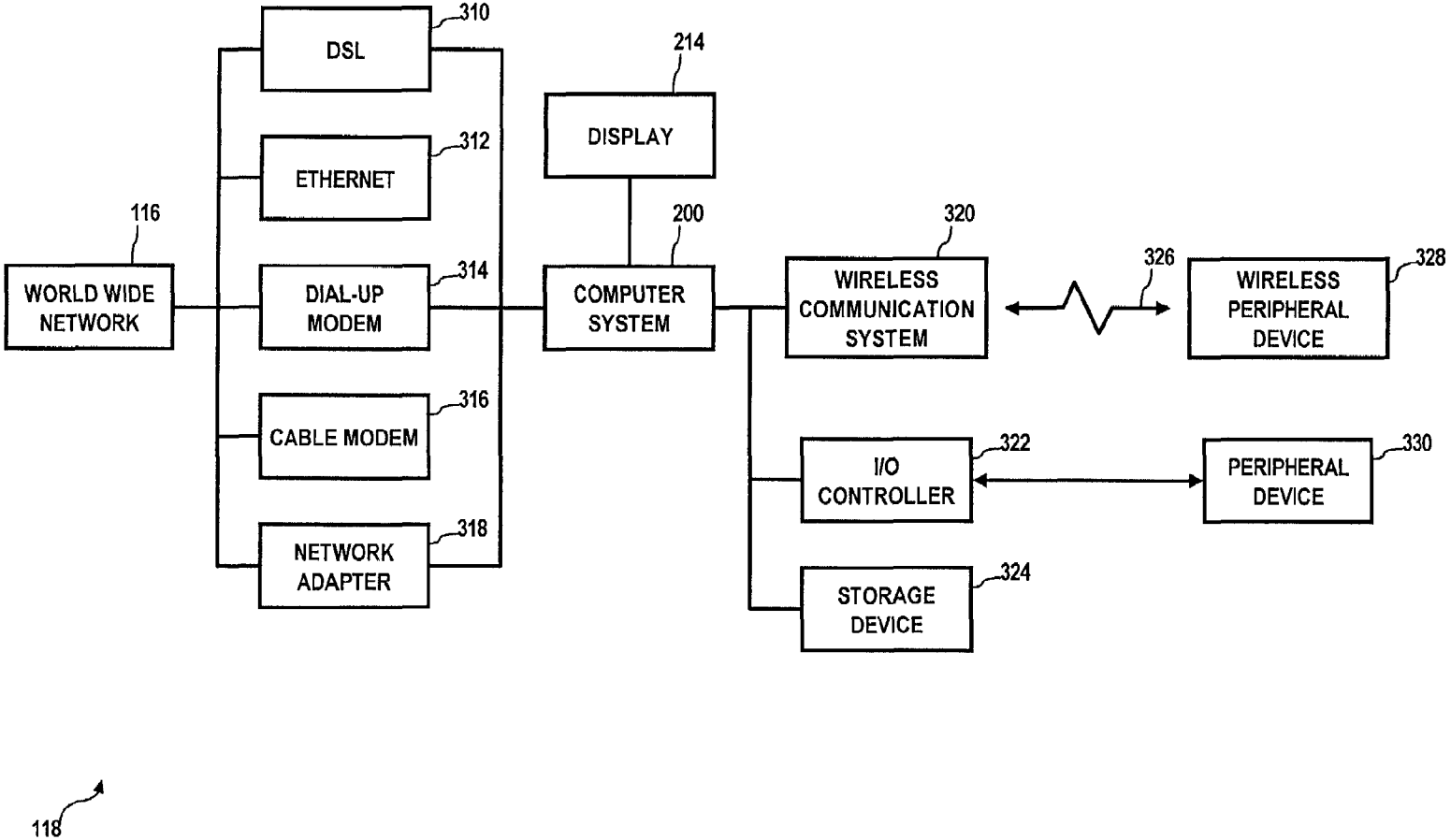
FIG. 3 is a block diagram of a media player in accordance with the present invention.

Referring now to FIG. 3, a media player apparatus for receiving an replaying a broadcast signal in accordance with the present invention will be discussed. Media player 118 may include at least one or more network coupling systems for communicating over world wide network 116. For example, media player 118 may include, for example, a digital subscriber line (DSL) modem 310, an Ethernet adapter 312, a dial-up modem 314, a cable modem 316, or any similar network adapter 318. Local receiver 112 of FIG. 1 may include a receiver for receiving a broadcast signal from broadcast station 110 and a system for converting the received broadcast signal into a format suitable for transmission via world wide network 116, and may include, for example, a computer system such as computer system 200 of FIG. 2. Thus, local receiver 112 is capable of transmitting via world wide network 116 the broadcast signal received from broadcast station 110 to media player 118 such that the signal is received with at least one of network coupling systems 310–318. The one or more network coupling systems are coupled to a computer system 200 of media player 118 which may be, for example, a microcontroller or embedded computer system such as computer system 200 shown in FIG. 2. Computer system 200 is coupled to a display for displaying status and control information of media player 118 to a user, and further to display a video signal, for example an embodiment in which the signal broadcast by broadcast station 110 is a television signal. In one embodiment of the present invention, computer system 200 may include an MP3 compatible coder/decoder (CODEC).

Computer system 200 of media player 118 is coupled to a storage device 324 for storing information. Storage device 324 may be, for example, semiconductor based memory or magnetic based memory such as a hard disk drive. Storage device 324 may be utilized, for example, to store a program of instructions executable by computer system 200 for controlling media player 118 and causing media player to implement a method for time and space domain shifting of a signal broadcast by broadcast station 110. Furthermore, storage device 324 is capable of storing a signal received by one or more of network coupling systems 310–318 via world wide network 116. In one particular embodiment, for example, computer system 200 is coupled to a wireless communication system 320 for communicating with a wireless peripheral device 328 via a wireless communication link 326. For example, wireless communication system 320 includes a frequency hopping, spread spectrum radio operating a 2.4 GHz for communicating to wireless peripheral device 328 via a radio-frequency signal. In one embodiment, wireless peripheral device 328 is at least one or a pair of amplified speakers having a suitable RF receiver for receiving a signal transmitted by wireless communication system 320. For example, broadcast station 110 broadcasts a radio signal that is received by local receiver 112 and transmitted to media player 118 via world wide network 116. Media player 118 receives the signal and decodes the signal such that the information (e.g., voice or music) is capable of being reproduced. It may be desirable to reproduce the information with one or more speaker and amplifier systems. So that the speaker and amplifier system may receive the signal without being coupled to media player 118 via wires, media player may transmit the signal to an amplifier and speaker system, operating as wireless peripheral device 328, via wireless communication link 326. Thus, media player 118 may be located in a first room while wireless peripheral device may be located in a second room. Furthermore, media player 118 may include an I/O controller 322 for communicating with a peripheral device 330 via a local network. The local network may be compliant with any suitable local network protocol such as Home PNA network, a Home RF network, a Bluetooth network, a HAVi network, etc.

Figure 4:
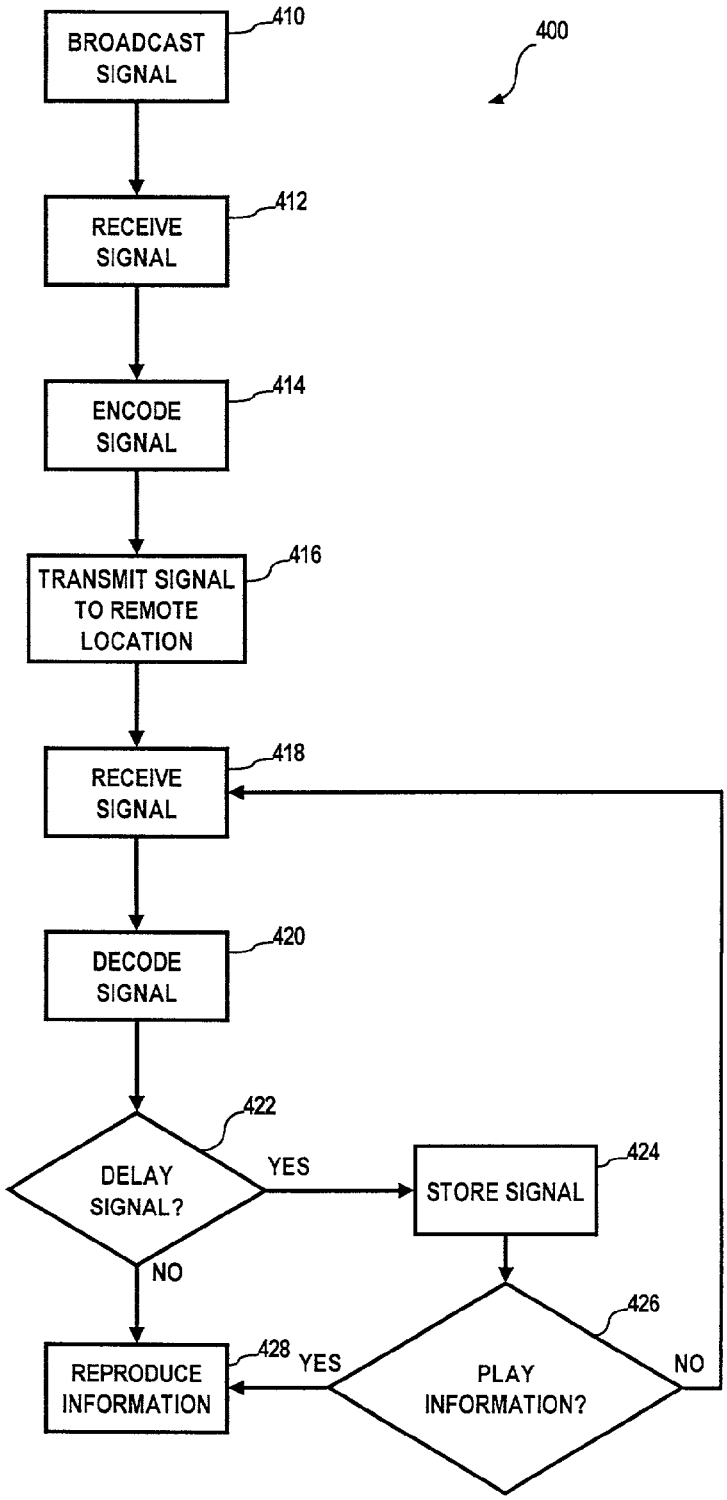
FIG. 4 is a flow diagram of a method for time and space domain shifting of broadcast signals in accordance with the present invention.

Referring now to FIG. 4, a method for time and space domain shifting of a broadcast signal in accordance with the present invention. Method 400 initiates with the broadcasting of a signal at step 410 by broadcast station 110. The signal is received by local receiver 112 at step 412. The signal is then encoded by local receiver 112 at step 414 into a format suitable for transmission via world wide network 116. The encoded signal is then transmitted at step 416 via world wide network 116 such that the signal is received by media player 118 at step 418. The signal is then decoded by media player 118 at step 420 such that the information contained in the signal is capable of being reproduced by media player 118 at step 428. A determination is made at step 422 whether to delay the signal to a later time frame. In the event it is determined to delay the signal to a later time frame, the signal is stored in storage device 324 at step 424. A determination may then be made at step 426 whether to play the stored information. In the event it is determined to play the stored in information, the information is produced at step 428. In the event it is determined to not play the stored information, method 400 may continue, for example, by receiving a signal via world wide network 116 at step 418. In one embodiment of the present invention, method 400 may be implemented as a program of instructions executed by computer system 200 for causing media player 118 to implement method 400. The program of instructions may be stored in storage device 324 or stored on a computer program product such as magnetic or optical disk storage medium.

Although the invention has been described with a certain degree of particularity, it should be recognized that elements thereof may be altered by persons skilled in the art without departing from the spirit and scope of the invention. One of the embodiments of the invention can be implemented as sets of instructions resident in the main memory 204 of one or more computer systems configured generally as described in FIG. 2. Until required by the computer system, the set of instructions may be stored in another computer readable memory such as auxiliary memory 206 of FIG. 2, for example in a hard disk drive or in a removable memory such as an optical disk for utilization in a CD-ROM drive, a floppy disk for utilization in a floppy disk drive, a floppy/optical disk for utilization in a floppy/optical drive, or a personal computer memory card for utilization in a personal computer card slot. Further, the set of instructions can be stored in the memory of another computer and transmitted over a local area network or a wide area network, such as the Internet, when desired by the user. Additionally, the instructions may be transmitted over a network in the form of an applet (a program executed from within another application) or a servlet (an applet executed by a server) that is interpreted or compiled after transmission to the computer system rather than prior to transmission. One skilled in the art would appreciate that the physical storage of the sets of instructions or applets physically changes the medium upon which it is stored electrically, magnetically, chemically, physically, optically or holographically so that the medium carries computer readable information.

It is believed that the method and apparatus for time and space domain shifting of broadcast signals of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A method comprising:

receiving a signal that was broadcast from a broadcast station in a first geographic location using a transmitter during a first time frame, the first geographic location defined as an area where a strength of the signal is sufficient for a receiver to detect the signal, the signal containing information capable of being reproduced;

encoding the signal to produce an encoded signal suitable for transmission via a world wide network;

transmitting the encoded signal via the world wide network;

receiving the encoded signal and converting it into a decoded signal in a second geographic location, the second geographic location defined as an area where the strength of the signal is insufficient for the receiver to detect the signal;

storing the decoded signal; and reproducing the information in the decoded signal in the second geographic location at a time chosen by a user of the information in the second geographic location during a second time frame;

where a delay between the first time frame and the second time frame is greater than a delay caused by receiving the signal, encoding the received signal, transmitting the encoded signal, receiving the encoded signal, and decoding the encoded signal.

2. The method of claim 1, the signal comprising a radio signal.

3. The method of claim 1, the signal comprising a television signal.

4. The method of claim 1, the world wide network comprising the Internet.

5. The method of claim 1, said receiving step, said encoding step, and said transmitting step implemented by a machine readable program of instructions capable of causing a machine to execute the method.

6. A method comprising:

receiving a signal that was broadcast from a transmitter in a first geographic location during a first time frame, the signal containing information capable of being reproduced;

encoding the signal to produce an encoded signal capable of being broadcast via a world wide network;

transmitting the encoded signal via the world wide network;

receiving the encoded signal via the world wide network in a second geographic location that is exclusive of the first geographic location, the second geographic location defined as an area where the strength of the signal is insufficient for the receiver to detect the signal;

decoding the encoded signal to produce a decoded signal;

storing the decoded signal; and reproducing the information in the decoded signal during a second time frame chosen by a user of the information in the second geographic location, wherein a delay between the first time frame and the second time frame is greater than a delay caused by receiving the signal, encoding the received signal, transmitting the encoded signal, receiving the encoded signal, and decoding the encoded signal.

7. The method of claim 6, the signal comprising a radio signal.

8. The method of claim 6, the signal comprising a television signal.

9. The method of claim 6, the world wide network comprising the Internet.

10. The method of claim 6, said receiving step, said decoding step, and said reproducing step being implemented by a machine readable program of instructions capable of causing a machine to execute the method.

11. A method comprising:

receiving a signal broadcast in a first geographic location during a first time frame, the signal containing information capable of being reproduced;

encoding the received signal into an encoded signal suitable for transmission via a world wide network;

transmitting the encoded signal via the world wide network;

receiving the encoded signal via the world wide network; and decoding the encoded signal such that the information is capable of being reproduced; and reproducing the information during a second time frame, wherein a delay between the first time frame and the second time frame is greater than a delay caused by receiving the signal, encoding the received signal, transmitting the encoded signal, receiving the encoded signal, and decoding the encoded signal.

12. A method as claimed in claim 11, the signal being a radio signal.

13. A method as claimed in claim 11, the signal being a television signal.

14. A method as claimed in claim 11, the world wide network being the Internet.

15. A method as claimed in claim 11, said receiving step, said encoding step, said transmitting step, said receiving step, said decoding step, and said reproducing step being implemented by a machine readable program of instructions capable of causing the machine to execute the method.

16. An apparatus comprising:

means for receiving a second broadcast via a world wide network, the second broadcast including an encoded signal, the encoded signal containing information that was transmitted in a first geographic location in a first time frame using a first broadcast, the first broadcast occurring prior to the second broadcast;

means for decoding the encoded signal into a decoded signal;

means, coupled to said decoding means, for storing the decoded signal; and means, coupled to said decoding means, for reproducing the information in a second geographic location in a second time frame, the second time frame chosen by a user of the information;

wherein a delay between the first time frame and the second time frame is greater than a delay caused by receiving the second broadcast and decoding the encoded signal.

17. The apparatus of claim 16, said receiving means capable of receiving the encoded signal via the Internet.

18. The apparatus of claim 16, said receiving means comprising a network coupling system.

19. The apparatus of claim 16, said decoding means comprising a computer system.

20. The apparatus of claim 16, said reproducing means comprising a computer system.

* * * * *